US008136350B2

(12) United States Patent
Duch et al.

(10) Patent No.: US 8,136,350 B2
(45) Date of Patent: Mar. 20, 2012

(54) CATALYTIC MUFFLER HAVING CROSSOVER PASSAGEWAY FOR SECONDARY AIR

(75) Inventors: David Duch, Brookfield, WI (US); Gary Gracyalny, Elm Grove, WI (US); John Thiermann, Greenfield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 949 days.

(21) Appl. No.: 12/128,355

(22) Filed: May 28, 2008

(65) Prior Publication Data

US 2009/0293462 A1 Dec. 3, 2009

(51) Int. Cl.

| | |
|---|---|
| ***F01N 3/00*** | (2006.01) |
| ***F01N 3/10*** | (2006.01) |
| ***F01N 3/02*** | (2006.01) |
| ***F01N 5/04*** | (2006.01) |
| ***F01N 1/14*** | (2006.01) |
| ***F01N 1/08*** | (2006.01) |

(52) U.S. Cl. ..... 60/299; 60/291; 60/317; 60/319; 181/262; 181/272

(58) Field of Classification Search ..... 60/289, 60/291, 302, 317, 319, 323, 299, 307, 308; 181/231, 232, 240, 262, 272, 283
See application file for complete search history.

(56) References Cited

U.S. PATENT DOCUMENTS

| | | | | |
|---|---|---|---|---|
| 4,851,015 | A | 7/1989 | Wagner et al. | |
| 4,890,690 | A | 1/1990 | Fischer et al. | |
| 4,916,897 | A | 4/1990 | Hayashi et al. | |
| 5,014,511 | A | 5/1991 | Wade et al. | |
| 5,277,026 | A | 1/1994 | Boll et al. | |
| 5,338,903 | A * | 8/1994 | Winberg | 181/231 |
| 5,339,629 | A | 8/1994 | Winberg et al. | |
| 5,548,955 | A | 8/1996 | Sandefur et al. | |
| 5,732,555 | A | 3/1998 | Gracyalny et al. | |
| 5,738,184 | A * | 4/1998 | Masuda et al. | 181/262 |
| 5,857,327 | A * | 1/1999 | Sato et al. | 60/302 |
| 5,902,971 | A * | 5/1999 | Sato et al. | 181/262 |
| 6,016,654 | A | 1/2000 | Schatz | |
| 6,393,835 | B1 | 5/2002 | Stoll et al. | |
| 6,910,550 | B2 * | 6/2005 | Schlossarczyk et al. | 181/283 |
| 6,978,605 | B2 * | 12/2005 | Chiba et al. | 60/302 |
| 7,448,204 | B2 * | 11/2008 | Nishimura et al. | 60/284 |

* cited by examiner

*Primary Examiner* — Thomas Denion
*Assistant Examiner* — Audrey K Bradley
(74) *Attorney, Agent, or Firm* — Michael Best & Friedrich LLP

(57) ABSTRACT

A catalytic muffler that treats the exhaust gases of an internal combustion engine. The catalytic muffler includes a catalyst chamber, a catalyst disposed in the catalyst chamber, an upstream chamber disposed upstream of the catalyst, an exhaust inlet configured to receive exhaust gases, an exhaust outlet configured to discharge converted gases converted by the catalyst to the atmosphere, and further configured to receive secondary air, and a passageway communicating between the exhaust outlet and the upstream chamber, and configured to provide the secondary air received by the exhaust outlet to the upstream chamber.

21 Claims, 14 Drawing Sheets

CATALYTIC MUFFLER HAVING CROSSOVER PASSAGEWAY FOR SECONDARY AIR

FIELD OF THE INVENTION

The present invention relates to catalytic mufflers used to treat the exhaust emissions of internal combustion engines. More particularly, this invention relates to catalytic mufflers used on small internal combustion engines that power lawnmowers, snow throwers, generators, pressure washers, and the like.

BACKGROUND OF THE INVENTION

Government regulations require that the exhaust emissions of small internal combustion engines be reduced. One way to reduce the exhaust emissions of small internal combustion engines is to use a catalytic converter to treat the exhaust emissions of the engine. In small internal combustion engines, it may be desirable to combine the catalytic converter with a muffler into a single, compact unit.

Catalytic converters or catalytic mufflers can greatly increase the cost of a small internal combustion engine, especially due in part to the cost of the catalyst used in the catalytic converter. Therefore, it is desirable to decrease the cost of the catalytic converters to the greatest extent possible.

SUMMARY

In one embodiment, the invention provides a catalytic muffler that treats the exhaust gases of an internal combustion engine. The catalytic muffler includes a catalyst chamber, a catalyst disposed in the catalyst chamber, an upstream chamber disposed upstream of the catalyst, an exhaust inlet configured to receive exhaust gases, an exhaust outlet configured to discharge converted gases converted by said catalyst to the atmosphere, and further configured to receive secondary air, and a passageway communicating between the exhaust outlet and the upstream chamber, and configured to provide the secondary air received by the exhaust outlet to the upstream chamber.

In another embodiment, the invention provides a method of treating the exhaust gases of an internal combustion engine using a catalytic muffler. The method includes discharging exhaust gases into an exhaust inlet of the catalytic muffler, directing the exhaust gases into a catalytic chamber of the catalytic muffler having a catalyst therein, drawing secondary air into an exhaust outlet of the catalytic muffler when a pressure in an upstream chamber disposed upstream of the catalyst is lower than atmospheric pressure, directing the secondary air through a passageway of the catalytic muffler into the upstream chamber, mixing the secondary air with the exhaust gas in the upstream chamber, directing the mixture of secondary air and exhaust gases through the catalyst positioned in the catalytic chamber to treat the exhaust emissions and create converted gases, directing the converted gases through a muffler chamber of the catalytic muffler, and directing the converted gases through the exhaust outlet of the catalytic muffler when a pressure in the muffler chamber is greater than atmospheric pressure.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
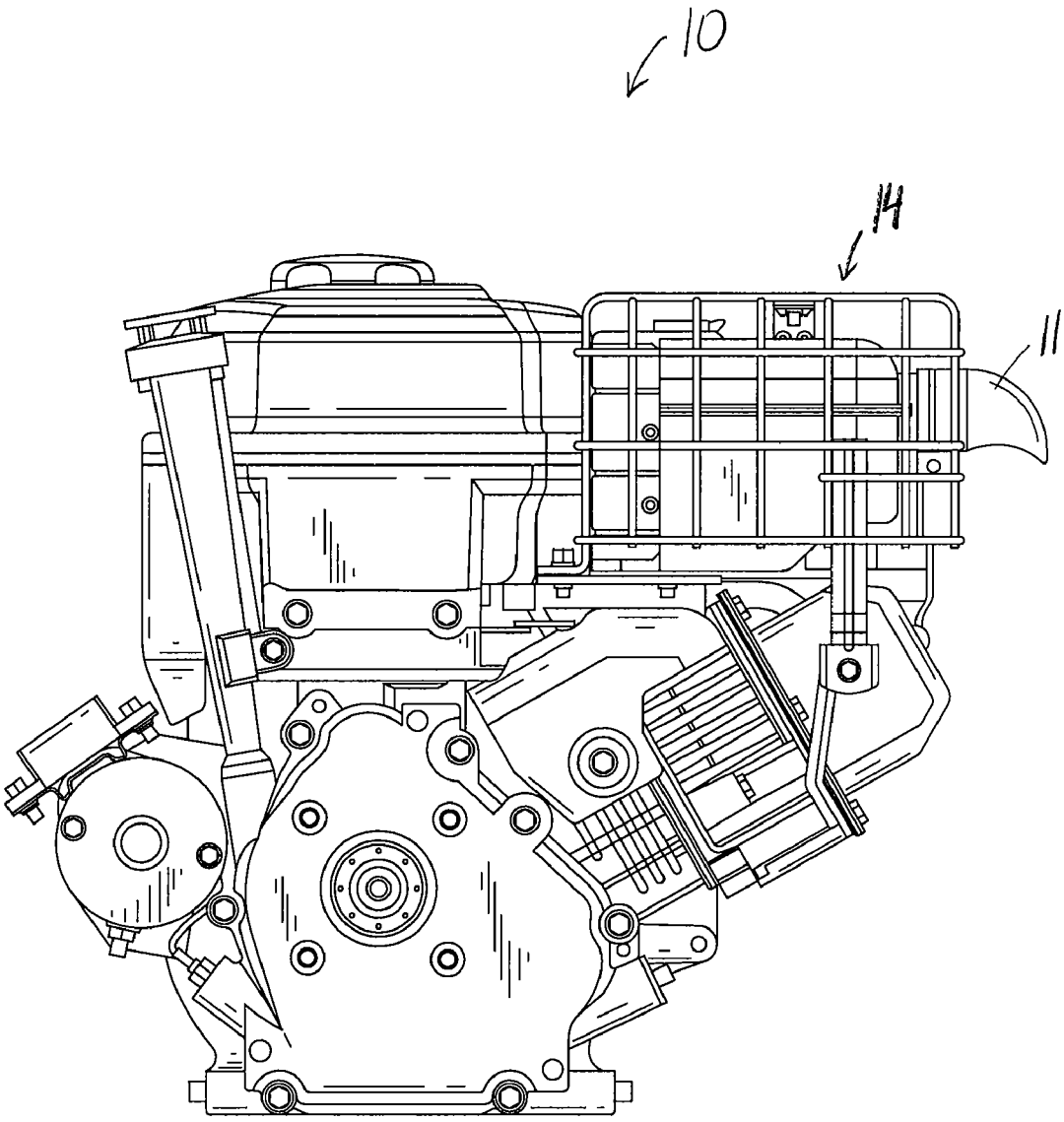
FIG. 1 is a side view of an internal combustion engine having a catalytic muffler according to the present invention.
Figure 2:
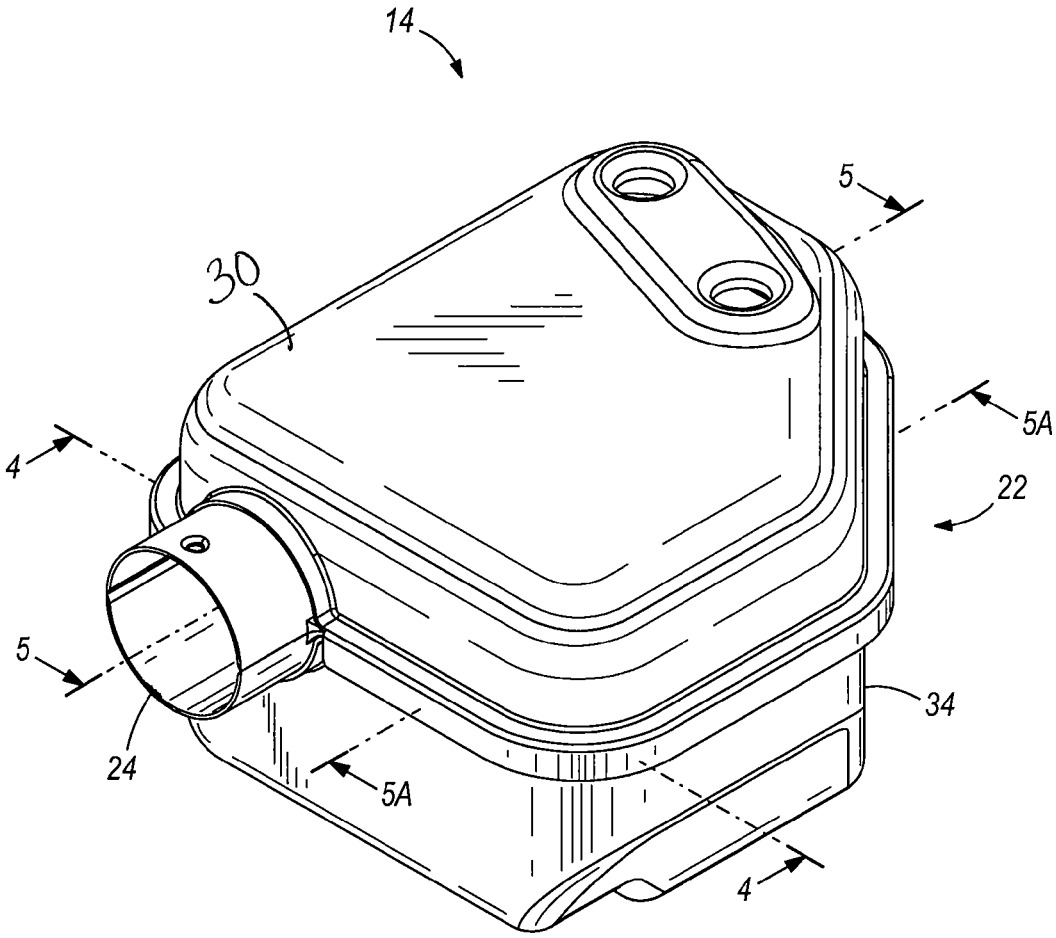
FIG. 2 is a perspective view of a catalytic muffler according to the present invention.

FIG. 1 illustrates an internal combustion engine 10 having a muffler assembly 14 according to one embodiment of the present invention. The engine is preferably a two or four-cycle type having one or two cylinders and a relatively low horsepower, i.e., less than about forty-five horsepower. The engine is a type of internal combustion engine that may be used to power lawn and garden equipment, lawnmowers, rotor tillers, generators, pressure washers, pumps, snowblowers, and other outdoor power equipment.

FIGS. 2 through 7 illustrate the muffler assembly 14 in more detail. The muffler assembly 14 includes a muffler housing 22 having an exhaust outlet 24 and an exhaust inlet 26. The muffler housing 22 is shown as a two-piece housing including a first housing section or member 30 and a second housing section or member 34 that may be crimped or otherwise held together. In other embodiments, the muffler housing may include three or more housing components. The muffler housing is preferably manufactured of steel or similar material stamped or formed in a suitable manufacturing process. The exhaust outlet 24 is an opening in the muffler housing 22 configured to discharge converted gases converted by a catalyst to the atmosphere, and further configured to receive secondary air. In other embodiments, the exhaust outlet may include a plurality of apertures, tubes, passageways, and like structure that are substantially positioned within the exhaust outlet. The muffler exhaust inlet 26 is connected to the exhaust outlet of the cylinder head of the engine.

Figure 3:
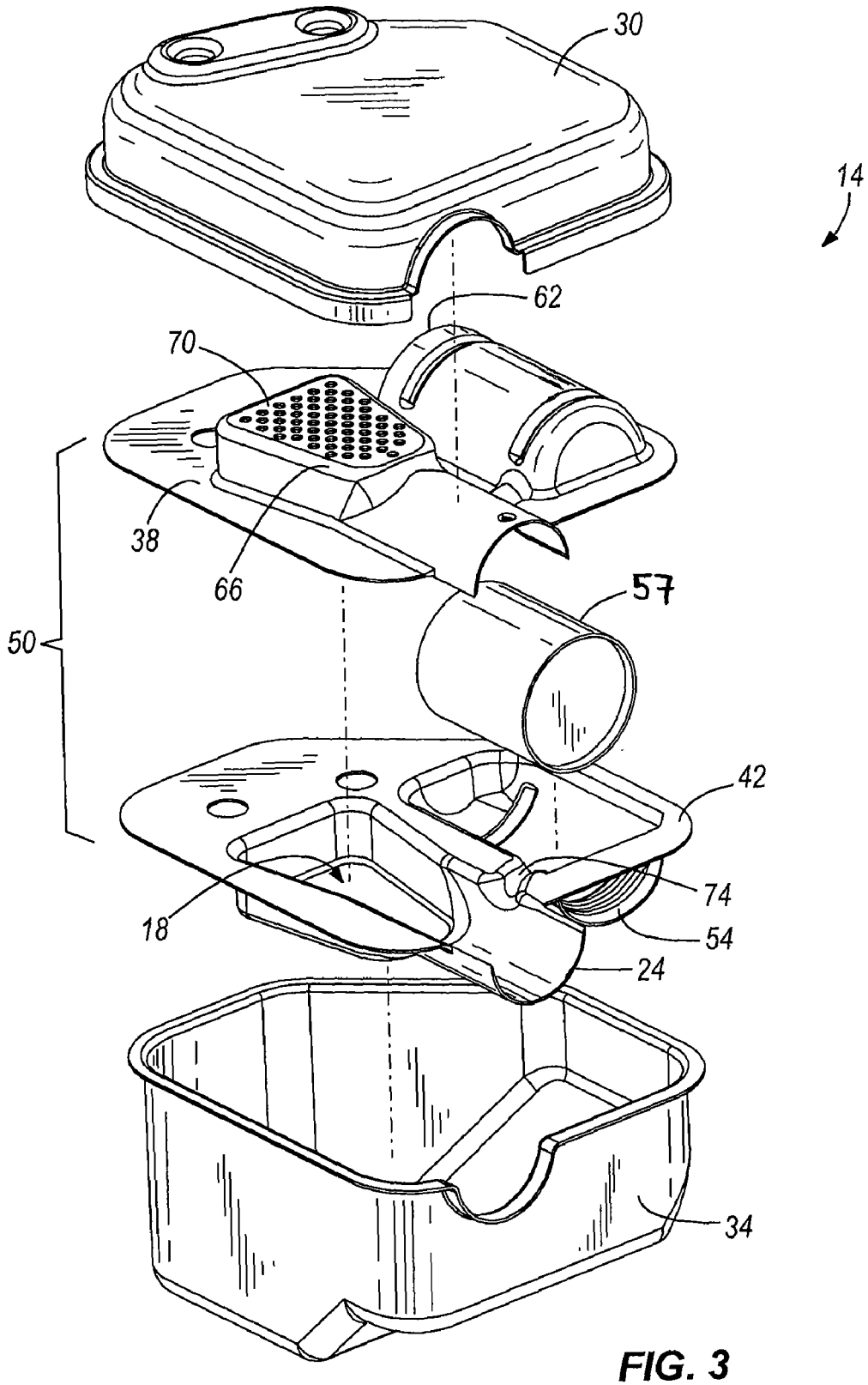
FIG. 3 is an exploded view of the catalytic muffler of FIG. 2.

FIG. 3 is an exploded view of the muffler assembly 14. The muffler assembly 14 further includes a first stamped baffle member 38, a second stamped baffle member 42 and a catalyst chamber 46 (see FIG. 4). Although the baffle members are preferably stamped, they could be formed by other methods. The muffler chamber 18 and the catalyst chamber 46 are formed in the internal spaces created by coupling the first stamped member 38 to the second stamped member 42 to form an integrated unit 50 (see FIG. 7). The muffler chamber 18 is sized and shaped to reduce noise levels from air flow throughout the muffler. The catalyst chamber 46 is formed by the recesses created by the mating of the first stamped baffle member 38 and the second stamped baffle member 42. The catalyst chamber 46 includes catalyst chamber inlet 54, an upstream or first chamber 56, a catalyst bed 58, a second chamber 60 and a catalyst chamber outlet 62 (see FIG. 5A). The first chamber 56 is positioned upstream of the catalyst bed 58, and the second chamber 60 is positioned downstream of the catalyst bed 58. The catalyst chamber inlet 54 is configured to direct exhaust gases from the internal combustion engine 10 into the upstream chamber 56 of the catalyst chamber 46. The catalyst bed 58 is positioned in the catalyst chamber 46. The catalyst bed 58 may have a cylindrical housing 57, as shown. The catalyst bed is preferably in the form of a honeycombed ceramic or other configuration having a large amount of surface area for the catalytic reactions to take place. The catalyst is generally a metal, such as including, but not limited to platinum, palladium, or rhodium. However, the catalyst can include any material that will enable an oxidation reaction to oxidize the hydrocarbons and a reduction reaction to reduce the NOx constituents of the exhaust gases. The catalyst is sized for desired emission reduction and engine displacement.

Figure 6:
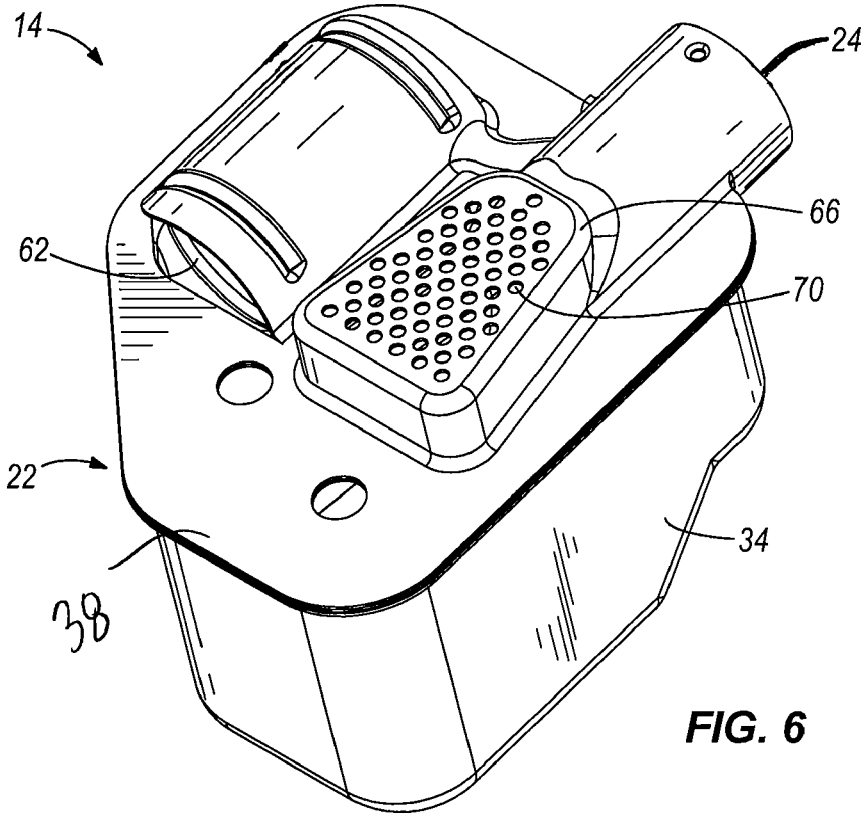
FIG. 6 is another perspective view of a portion of the catalytic muffler of FIG. 2.
Figure 7:
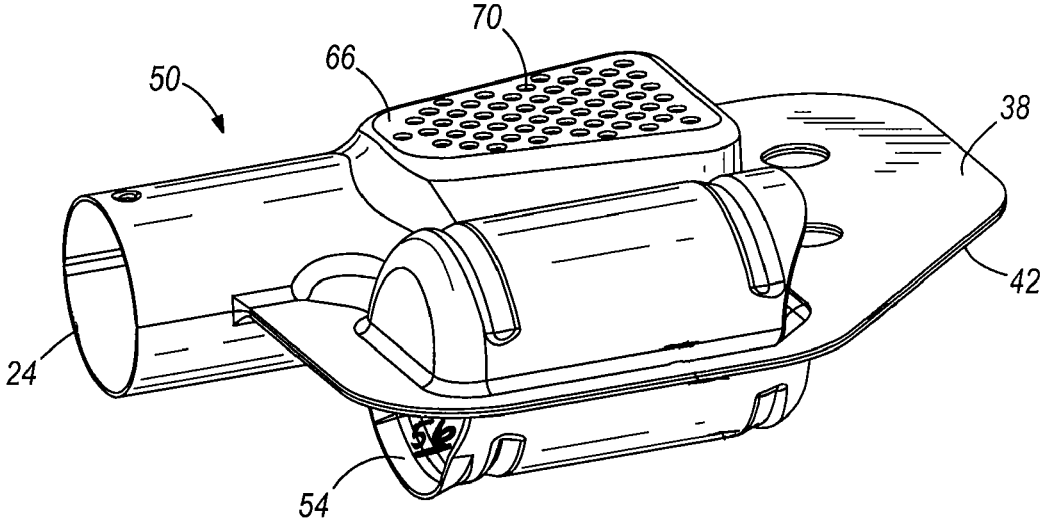
FIG. 7 is a side perspective view of the integrated unit of the catalytic muffler of FIG. 2.
Figure 8:
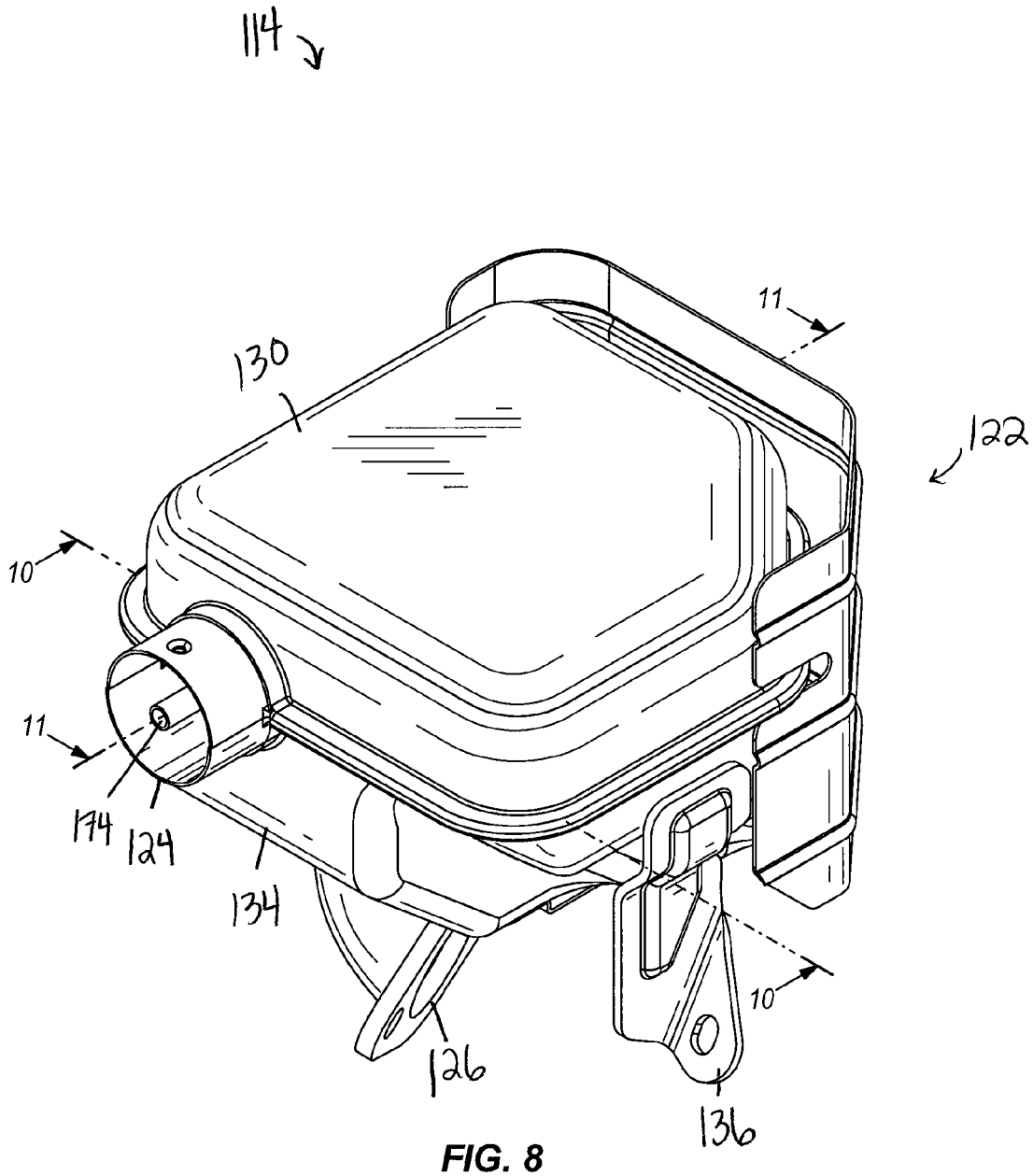
FIG. 8 is a perspective view of the catalytic muffler according to another embodiment of the invention.

The first stamped member 38 includes a baffle 66 having perforations 70 (see FIG. 6). The baffle 66 with perforations 70 is configured to attenuate gas flow noise by permitting gas flow to the interior of the muffler chamber 18. The perforations 70 work in conjunction with the muffler housing 22 to reduce the gas flow noise. The second stamped member 42 is a separator that further separates the muffler chamber 18 from the rest of the muffler housing 22.

Figure 4:
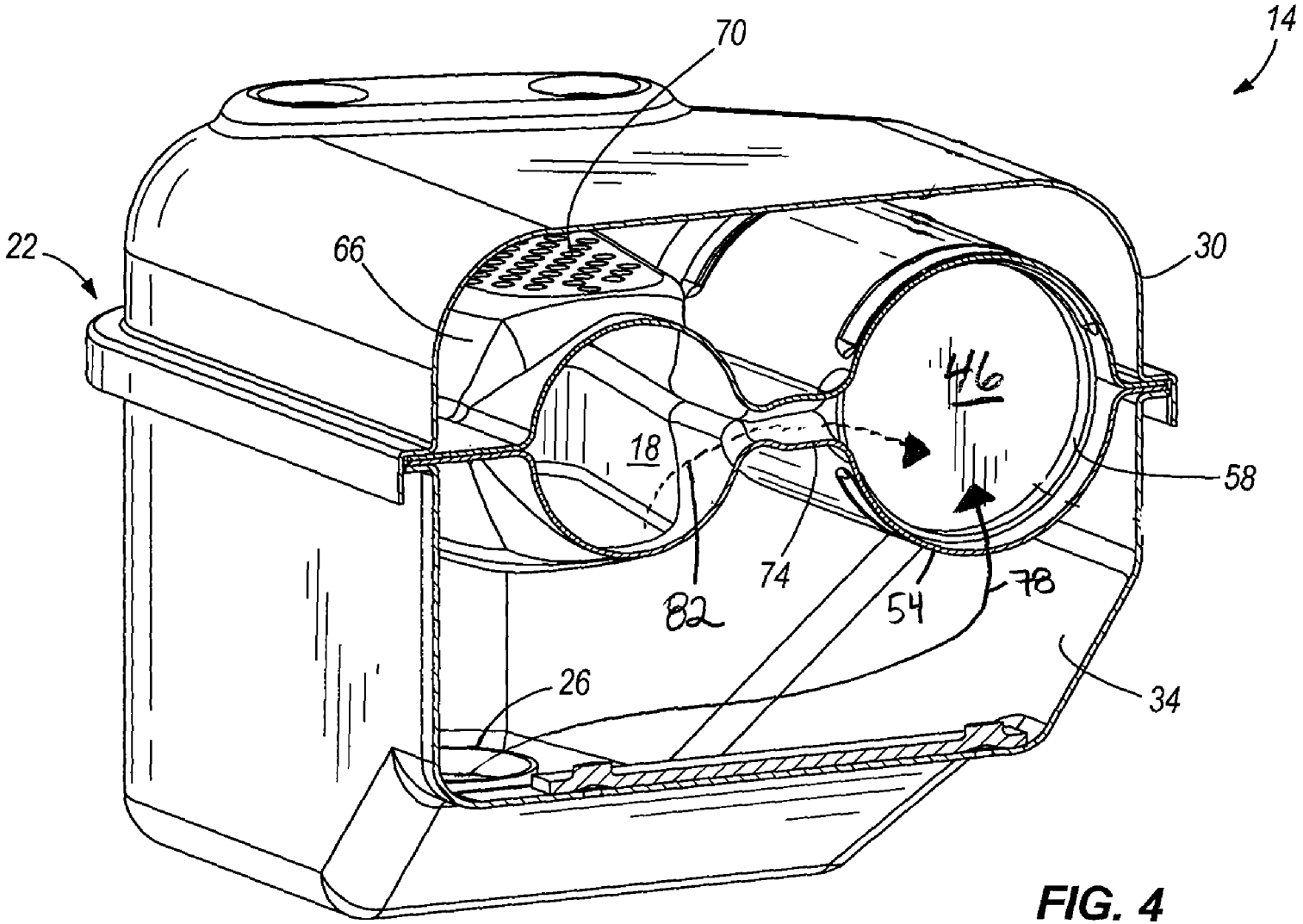
FIG. 4 is a cross-sectional view of the catalytic muffler, taken along line 4-4 of FIG. 2.
Figure 5:
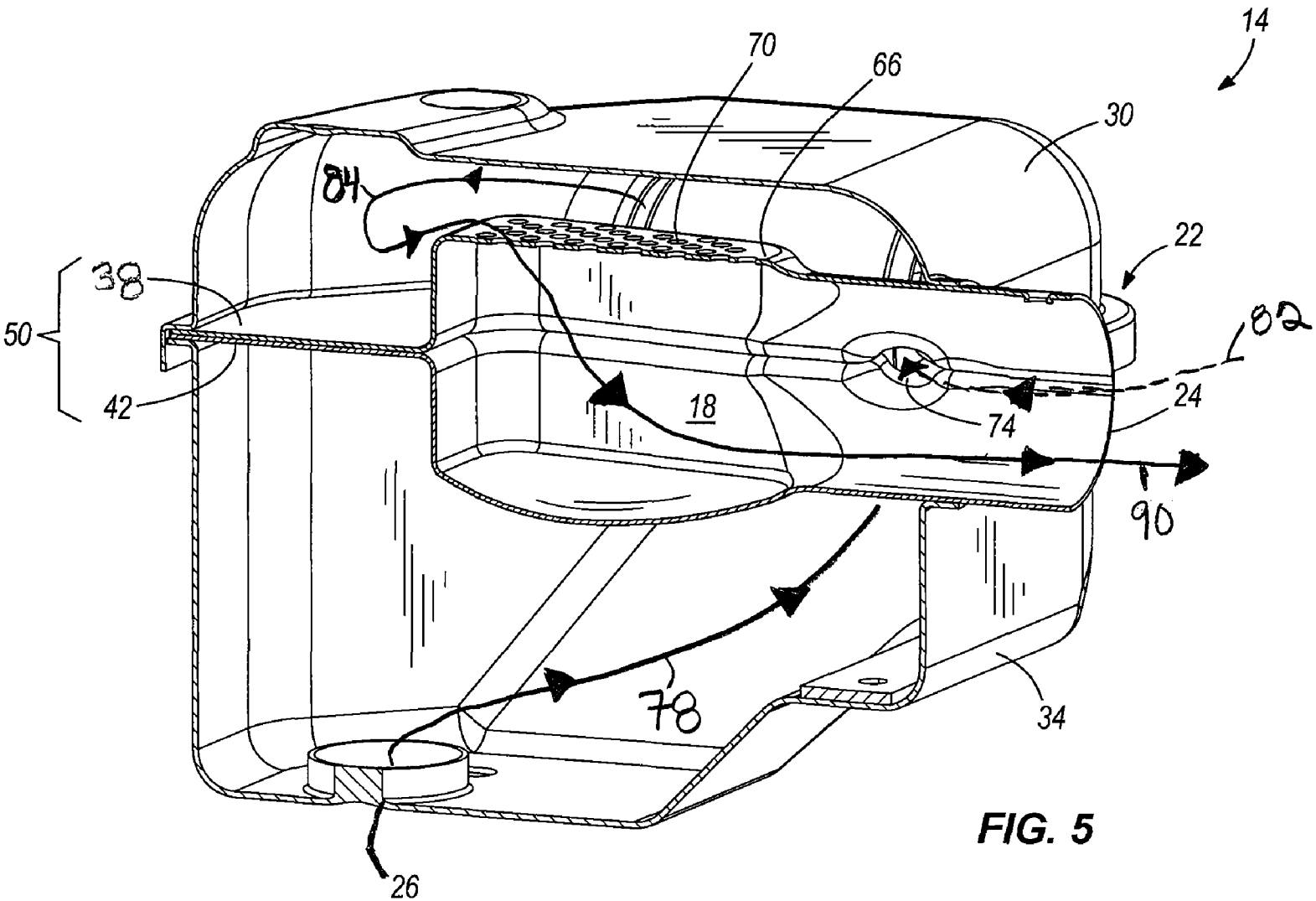
FIG. 5 is a cross-sectional view of the catalytic muffler, taken along line 5-5 of FIG. 2.

As shown in FIGS. 4 and 5, a passageway 74 is formed between the catalytic chamber 46 and the muffler chamber 18. The passageway 74 provides communication between the exhaust outlet 24 and the catalytic chamber 46. More particularly, the passageway 74 provides a conduit that allows secondary air drawn in through the exhaust outlet 24 to enter the upstream chamber 56 and be used for the oxidation reaction. The passageway 74 may have any shape that forms a conduit between the exhaust outlet 24 and the upstream chamber 56. Since the passageway 74 is preferably formed by mating of the first baffle member 38 and the second baffle member 42, there may be no additional cost or material needed to form the passageway 74 between the exhaust outlet 24 and the upstream chamber 56. The passageway 74 is sized to control the amount of secondary air that enters the upstream chamber 56 by restricting the diameter or size of the passageway. The more secondary air that enters the catalytic chamber, the more oxidation reaction possible and the higher the catalyst temperature. To control the catalyst temperature, the amount of secondary air is metered by the size of the passageway. Also, the amount of secondary air is controlled to permit the subsequent reduction of nitrous oxides after the oxygen has been depleted. The passageway must also be restricted enough so the amount of untreated exhaust and noise traveling in the reverse direction through the passageway and out of the exhaust outlet 24 is minimized.

Figure 5A:
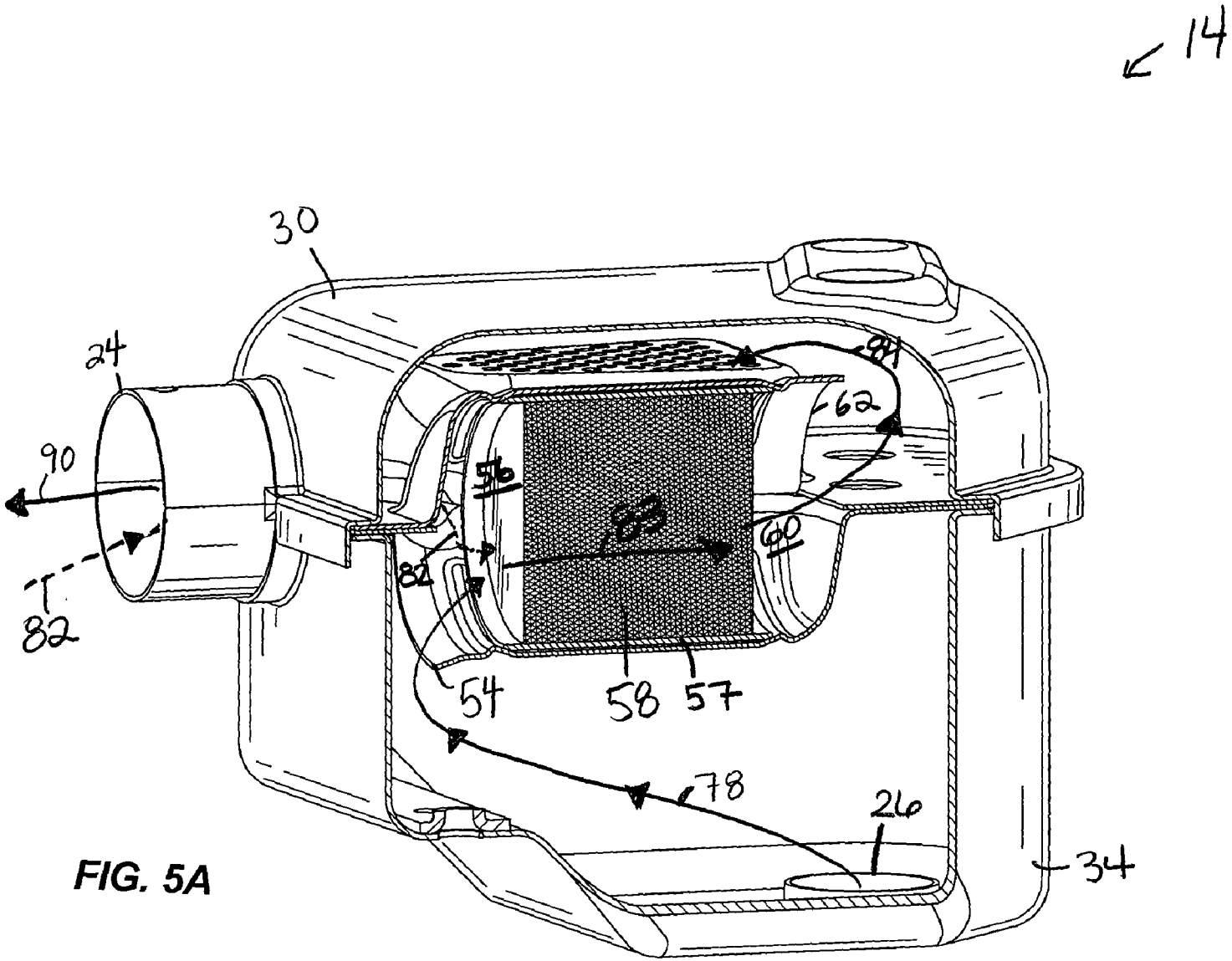
FIG. 5A is a cross-sectional view of the catalytic muffler, taken along line 5A-5A of FIG. 2, illustrating the catalytic chamber.

In operation and as shown in FIGS. 4, 5 and 5A, exhaust gases enter the catalytic chamber 46 through the catalyst chamber exhaust inlet 54 (see path 78). When the pressure in the upstream chamber is lower than atmospheric pressure, secondary air is drawn into the exhaust outlet 24 (see path 82). Secondary air enters exhaust outlet 24, then passageway 74, then upstream chamber 56 of catalyst chamber 46 (see path 82). The exhaust gases mix with secondary air in the upstream chamber 56. The mixture of untreated exhaust gas and secondary air proceeds into the catalyst bed 58 where the exhaust gases are treated (see path 83) in FIG. 5A. The treated or converted gases then pass into second chamber 60 and exit the catalyst chamber 46 through the catalyst chamber outlet 62, and travel through the perforations 70 in the baffle 66 into the muffler chamber 18 (see path 84). The converted gases are then output from the muffler chamber 18 through the exhaust outlet 24 when a pressure in the muffler chamber is greater than atmospheric pressure (see path 90).

Effectively, the passageway 74 allows for secondary air, or additional air, to be made available for the oxidation reactions without the need for a separate secondary air inlet or a check valve. Furthermore, the exhaust outlet 24 serves as a bi-directional orifice, such that exhaust gases are delivered to the exterior of the muffler housing 22 when pressure in the muffler chamber is greater than atmospheric pressure, whereas secondary air is drawn into the integrated unit 50 through the exhaust outlet 24 when the pressure in the upstream chamber is lower than atmospheric pressure.

FIGS. 8 through 13 illustrate another embodiment of the muffler assembly 114 of the present invention. The muffler assembly shown in FIGS. 8 through 13 includes similar structure to the muffler assembly 14 illustrated in FIGS. 2 through 7 described above. The muffler assembly 114 further includes a muffler housing having an exhaust outlet 124 and an exhaust inlet 126. The muffler housing 122 is shown as a two-piece housing including a first housing section 130 and a second housing section 134 that may be crimped or otherwise held together. The muffler housing 122 may further include a mounting device 136 configured to mount or otherwise attach the muffler assembly 114 to the engine 10.

Figure 9:
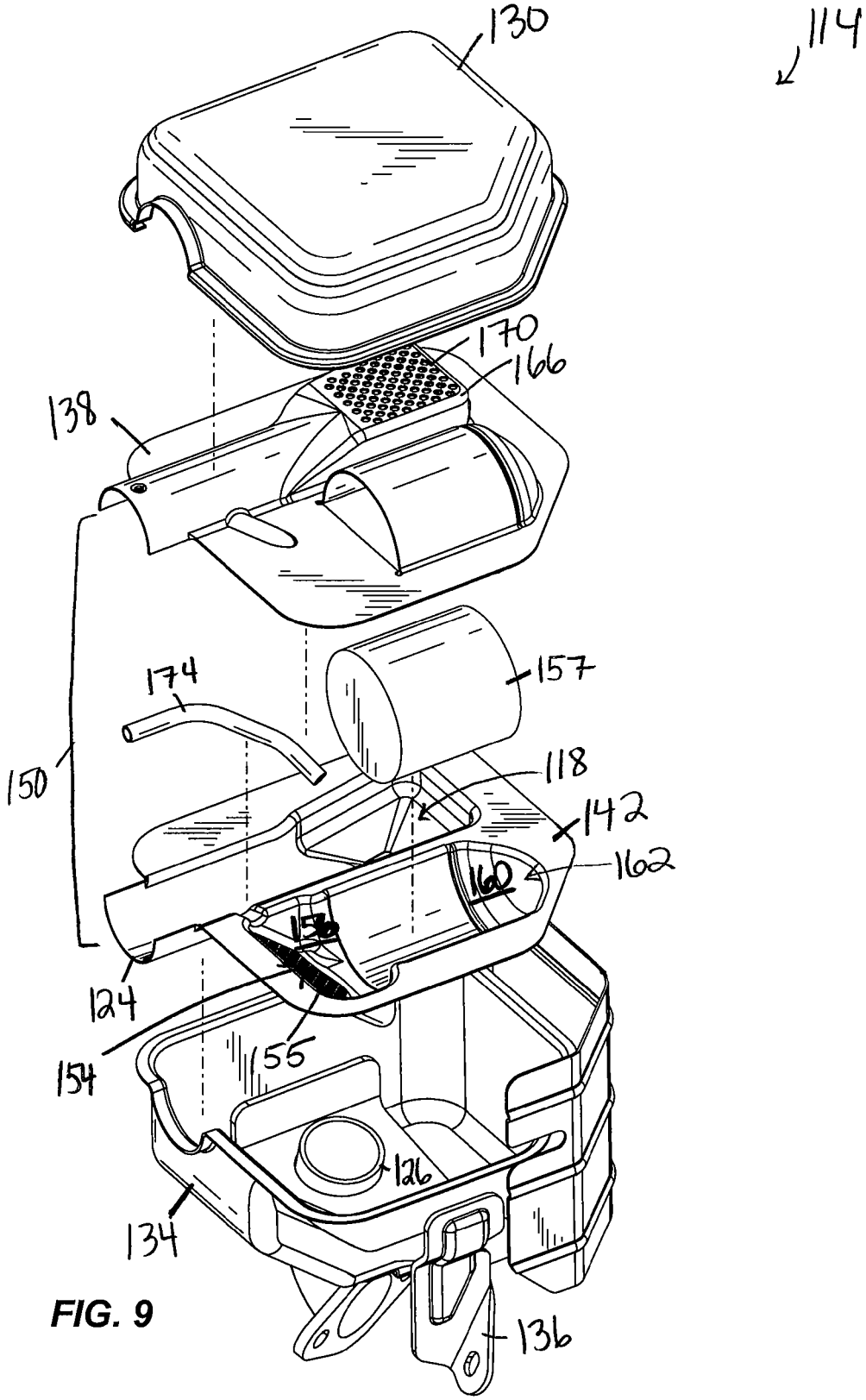
FIG. 9 is an exploded view of the catalytic muffler of FIG. 8.

FIG. 9 is an exploded view of the muffler assembly 114. The muffler assembly 114 further includes a first stamped baffle member 138, a second stamped baffle member 142 and a catalyst chamber 146. The muffler chamber 118 and the catalyst chamber 146 are formed in the internal spaces created by coupling the first stamped member 138 to the second stamped member 142 to form an integrated unit 150 (see FIG. 13). The catalyst chamber 146 includes catalyst chamber inlet 154, an upstream or first chamber 156, a catalyst bed 158 having a housing 157, a second chamber 160 and a catalyst chamber outlet 162. As shown, the catalyst chamber inlet 154 includes a baffle plate 155 to reduce noise in the muffler assembly 114. The first stamped member 138 may include a baffle 166 having perforations 170 (see FIG. 12). The baffle 166 with perforations 170 is configured to attenuate gas flow noise by permitting gas flow to the interior of the muffler chamber 118.

Figure 10:
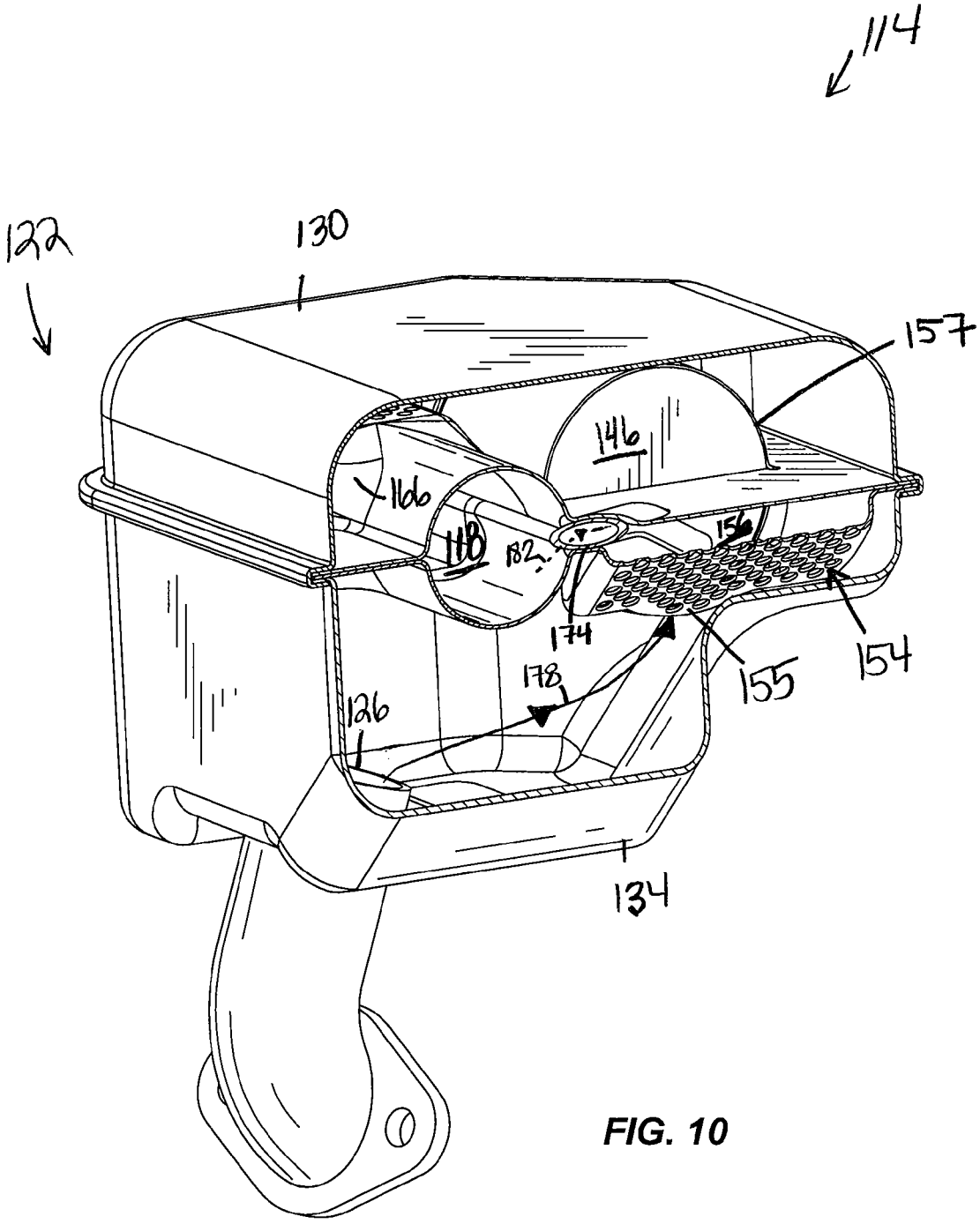
FIG. 10 is a cross-sectional view of the catalytic muffler taken along line 10-10 of FIG. 8.
Figure 11:
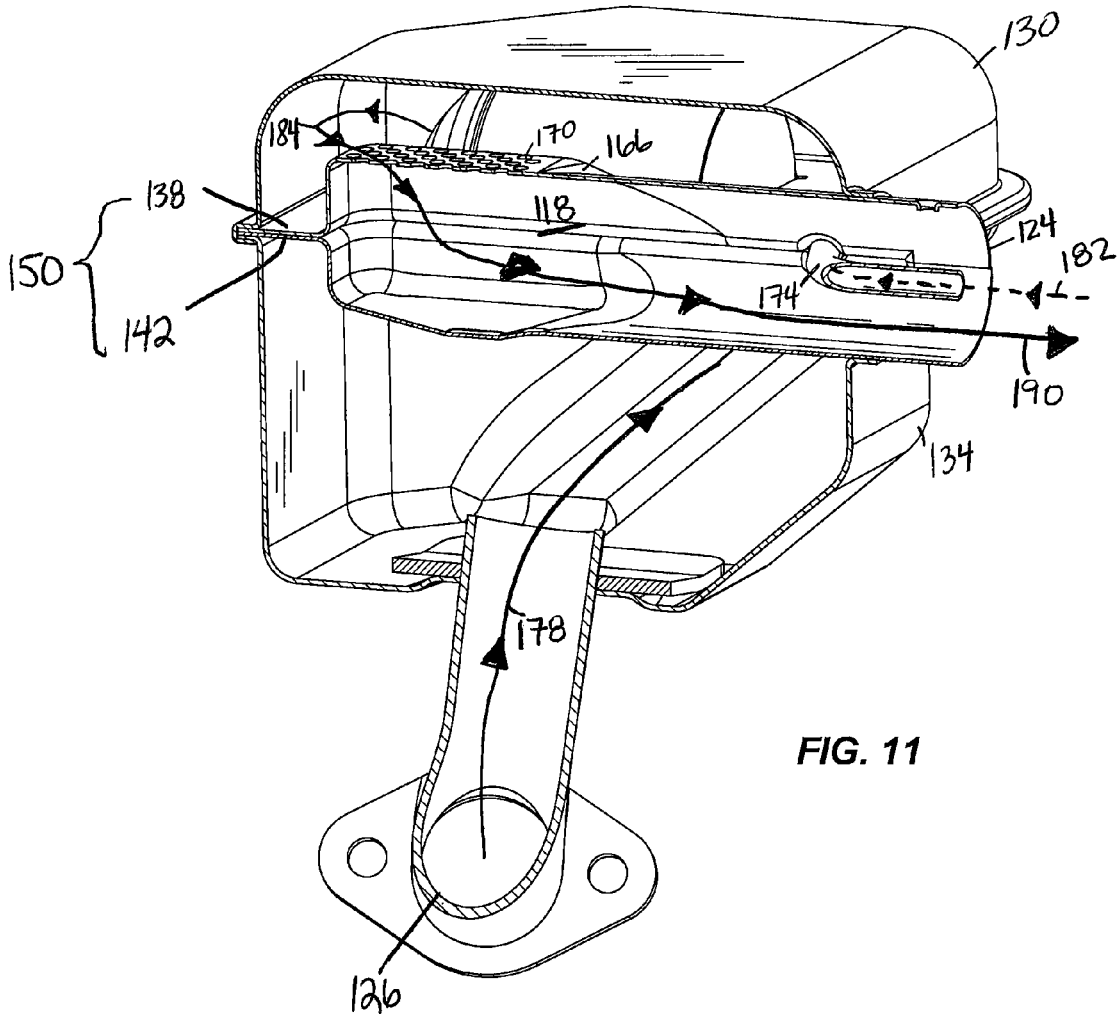
FIG. 11 is a cross-sectional view of the catalytic muffler taken along line 11-11 of FIG. 8.
Figure 12:
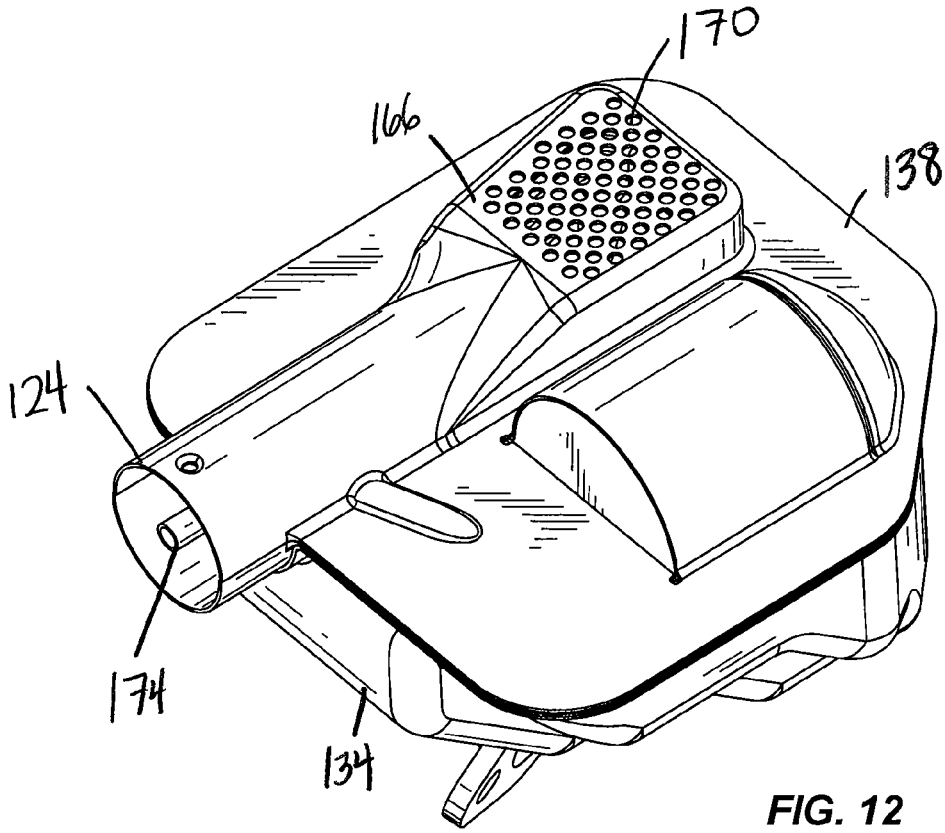
FIG. 12 is another perspective view of a portion of the catalytic muffler of FIG. 8.
Figure 13:
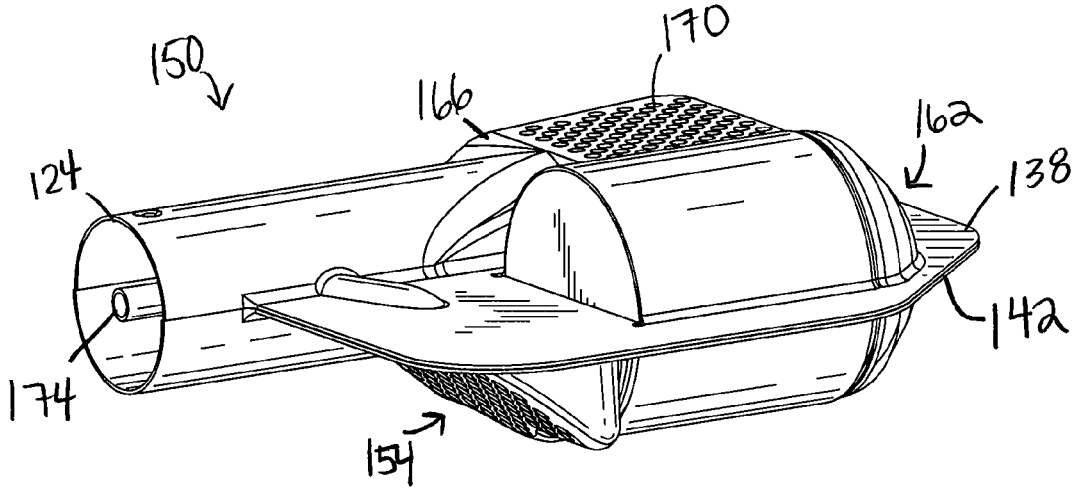
FIG. 13 is a perspective view of the integrated unit of the catalytic muffler of FIG. 8.

As shown in FIGS. 9 through 11, a passageway 174 is formed between the catalytic chamber 146 and the muffler chamber 118. The passageway 174 provides communication between the exhaust outlet 124 and the catalytic chamber 146. More particularly, the passageway 174 provides a conduit that allows secondary air drawn in through the exhaust outlet 124 to be mixed with exhaust gases in the upstream chamber 156. The secondary air enters the upstream chamber 156 through passageway 174 (see path 182). Exhaust gases enter the upstream chamber 156 through the chamber exhaust inlet 154 (see path 178). The mixture of exhaust gas and secondary air proceeds to the catalyst bed 158, wherein the exhaust gases are treated. The treated gases proceed through second chamber 160, exit the catalyst chamber 146, and proceed into the muffler chamber 118 (see path 184). The converted gases are then output through the exhaust outlet (see path 190) in FIG. 11. The passageway 174 is shown as a tubular structure. The passageway may have any shape that forms a conduit between the exhaust outlet and the upstream chamber. The passageway 174 is sized to control the amount of secondary air that enters the upstream chamber by restricting the diameter or size of the passageway.

Figure 14:
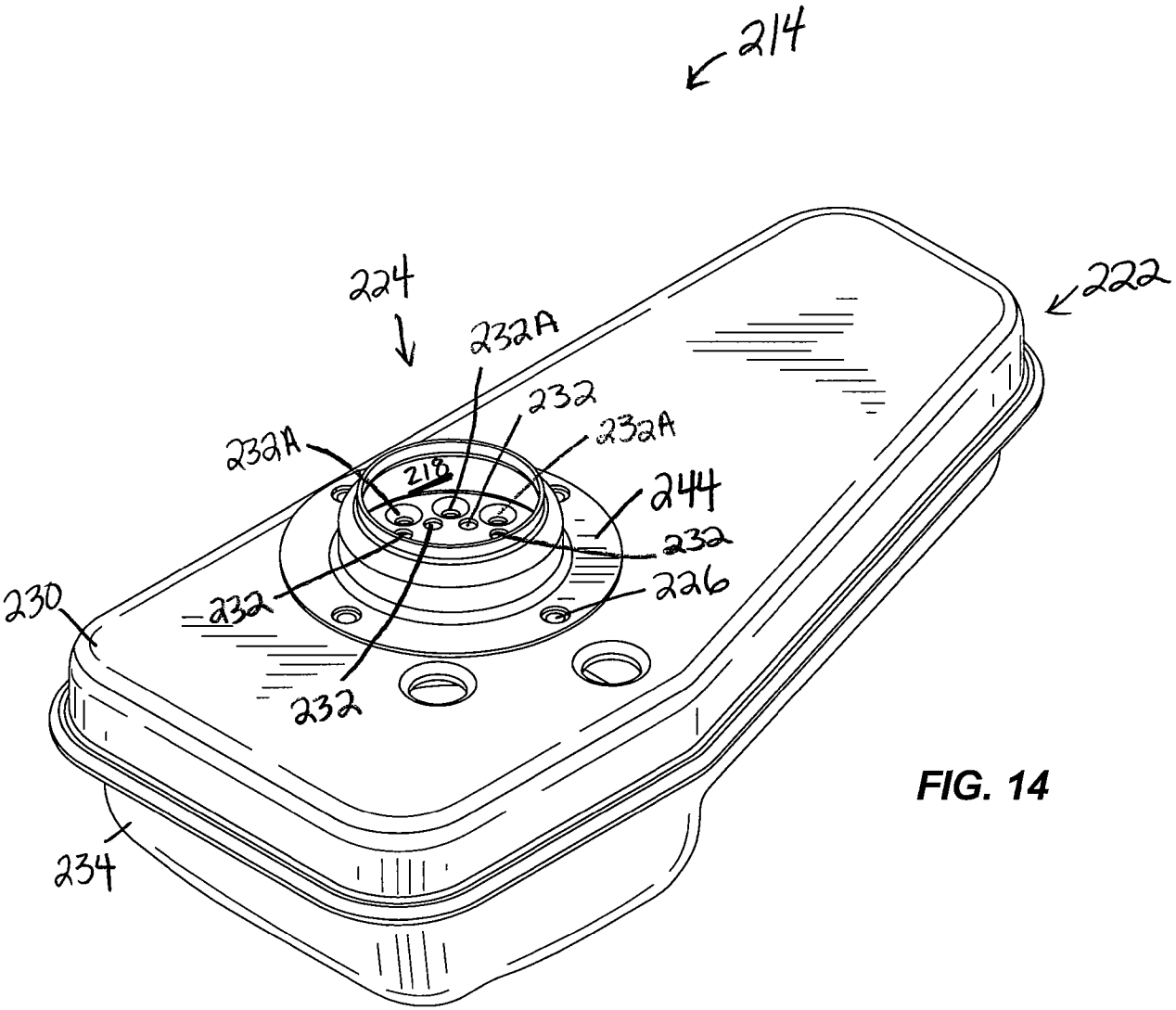
FIG. 14 is a perspective view of the catalytic muffler according to another embodiment of the invention.
Figure 15:
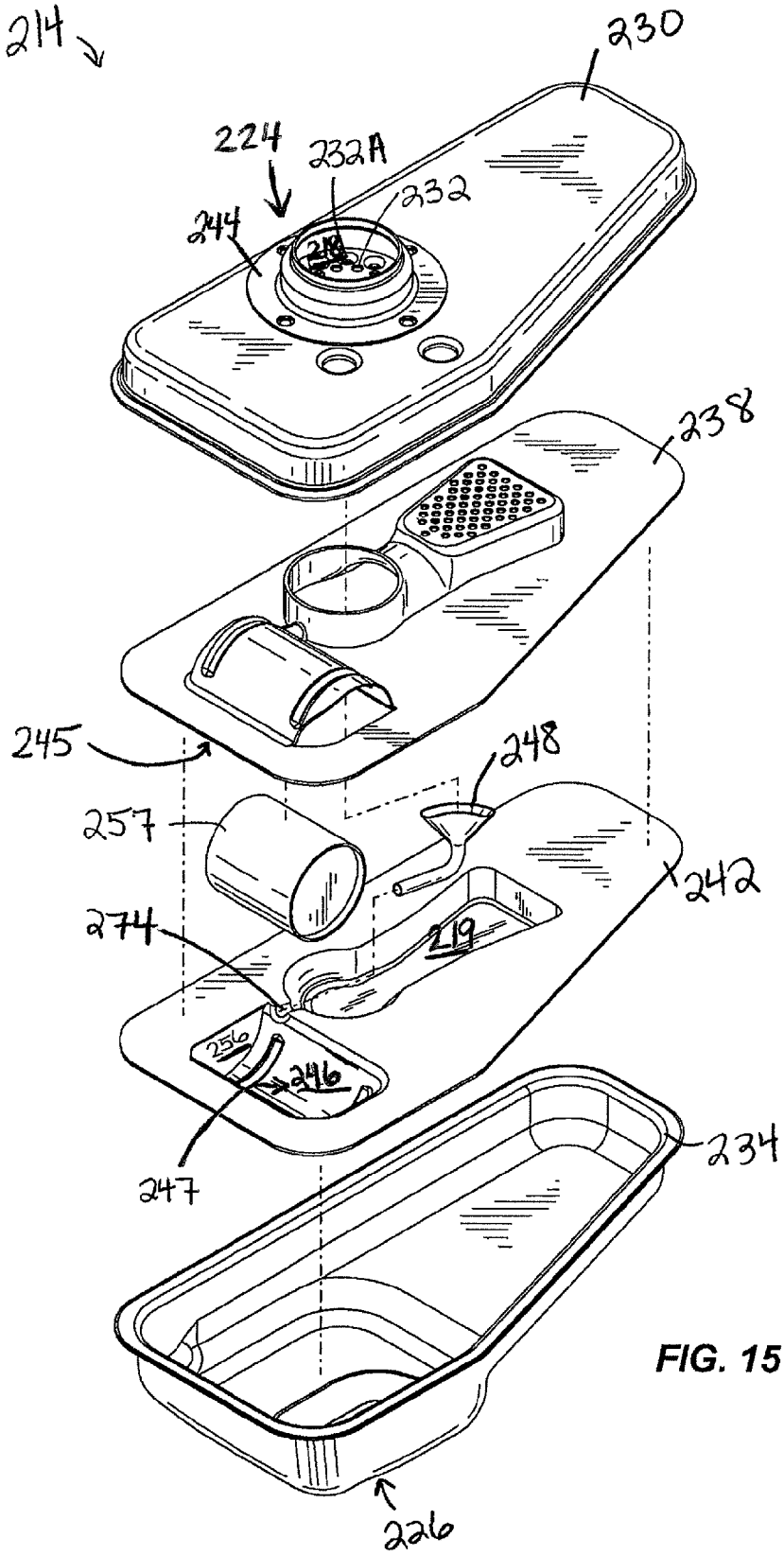
FIG. 15 is an exploded view of the catalytic muffler of FIG. 14.

FIGS. 14 and 15 illustrate another embodiment of the muffler assembly 214 of the present invention. The muffler assembly shown in FIGS. 14 and 15 includes similar structure to the muffler assembly 14 illustrated in FIGS. 2 through 7 described above and the muffler assembly 114 illustrated in FIGS. 8 through 13 described above. The exhaust outlet 224 has an aperture 218 formed in an exhaust guide 244. The exhaust guide 244 is adapted to be attached or otherwise coupled to the muffler housing 222 with a plurality of fasteners 226 or the like. The exhaust guide 244 is preferably manufactured of steel or similar material stamped or formed in a suitable manufacturing process. The muffler housing 222 has a first housing section 230, a second housing section 234, a first stamped baffle member 238, a second stamped baffle member 242, and an exhaust inlet 226.

The exhaust outlet 224 further includes a plurality of apertures 232 configured to discharge converted gas. Several apertures 232A primarily receive secondary air. The exhaust guide 244 is configured to concentrate and direct the exhaust flow from the plurality of apertures 232 when the pressure in the muffler chamber 219 is greater than atmospheric pressure. The exhaust guide 244 is further configured to concentrate and direct the secondary air entering the plurality of apertures 232A when the pressure in the upstream chamber 256 is lower than atmospheric pressure. In other embodiments, the exhaust outlet may include a plurality of apertures, tubes, passageways, and the like to be used with the guide plate. In other embodiments, the exhaust outlet may include a deflector 11 (see FIG. 1). The catalyst chamber 246 is created between recess 245 of baffle plate 238 and recess 247 of baffle plate 242.

A channel 248 directs secondary air from the apertures 232A through a passageway 274 to the upstream chamber 256. The channel 248 provides a conduit for the secondary air to directly enter the upstream chamber 256 before mixing with the exhaust gas and proceeding to the catalyst bed 257. The channel 248 is illustrated as a funnel structure. However, in other embodiments, the channel may include a tube, cone, or other device configured to gather the secondary air and direct the secondary air to the first chamber. The embodiment shown in FIGS. 14 and 15 otherwise functions in a manner similar to the other embodiment discussed herein.

Various features and advantages of the invention are set forth in the following claims.

What is claimed is:

1. A catalytic muffler that treats the exhaust gases of an internal combustion engine, the catalytic muffler comprising:

a catalyst chamber;

a catalyst disposed in the catalyst chamber;

an upstream chamber disposed upstream of the catalyst;

an exhaust inlet configured to receive exhaust gases;

an exhaust outlet configured to discharge converted gases converted by said catalyst to the atmosphere;

a muffler chamber positioned downstream of the catalyst chamber, the converted gases passing through the muffler chamber prior to being discharged from the exhaust outlet; and a passageway communicating the muffler chamber and the upstream chamber through which secondary air passing through the muffler chamber is provided to the upstream chamber.

2. The catalytic muffler of claim 1, further comprising an exhaust guide coupled to the exhaust outlet and configured to concentrate and direct the flow of discharged gases and secondary air.

3. The catalytic muffler of claim 1, further comprising a channel configured to direct secondary air through the muffler chamber to the passageway.

4. The catalytic muffler of claim 1, further comprising a perforated baffle configured to attenuate gas flow noise.

5. The catalytic muffler of claim 1, wherein the passageway is configured to minimize exhaust flow through the passageway.

6. The catalytic muffler of claim 1, wherein the exhaust outlet is configured to discharge converted gases when a pressure in a muffler chamber is greater than atmospheric pressure.

7. The catalytic muffler of claim 1, wherein the exhaust outlet is configured to receive secondary air when the pressure in the upstream chamber is lower than atmospheric pressure.

8. The catalytic muffler of claim 1, further comprising a tubular structure at least partially disposed within the muffler chamber.

9. The catalytic muffler of claim 8, wherein the tubular structure is further disposed within the passageway and configured to provide secondary air to the upstream chamber.

10. The catalytic muffler of claim 1, wherein the muffler chamber is formed by at least one of a first member and a second member.

11. The catalytic muffler of claim 10, wherein the muffler chamber is formed by the first member and the second member.

12. The catalytic muffler of claim 11, wherein the muffler chamber and the catalytic chamber are formed by the first member and the second member.

13. The catalytic muffler of claim 1, wherein the catalyst chamber is formed from at least one of a first member and a second member.

14. The catalytic muffler of claim 13, further comprising a second chamber downstream of the catalyst, and wherein at least one of the upstream chamber and the second chamber is formed from at least one of the first member and the second member.

15. The catalytic muffler of claim 13, wherein the first member and the second member further include a first baffle member and a second baffle member.

16. The catalytic muffler of claim 15, further comprising a second chamber downstream of the catalyst, and wherein at least one of the upstream chamber and the second chamber is formed in at least one of the first baffle member and of the second baffle member.

17. The catalytic muffler of claim 1, wherein the passageway is formed from at least one of a first member and a second member.

18. The catalytic muffler of claim 17, wherein the passageway is formed from both the first member and the second member.

19. The catalytic muffler of claim 17, wherein the first member and the second member further include a first baffle member and a second baffle member.

20. The catalytic muffler of claim 19, wherein the passageway is formed from at least one of the first baffle member and the second baffle member.

21. The catalytic muffler of claim 20, wherein the passageway is formed from both the first baffle member and the second baffle member.

* * * * *